United States Patent [19]

Cho

[11] Patent Number: 4,714,245

[45] Date of Patent: Dec. 22, 1987

[54] PIVOTAL SKIPPING ROPE HANDLES HAVING SPRING RESISTANCE

[76] Inventor: Myung H. Cho, 205-153, Cheongryang 2-Dong, Dongdaemoon-Ku, Seoul, Rep. of Korea

[21] Appl. No.: 761,895

[22] Filed: Aug. 2, 1985

Related U.S. Application Data

[62] Division of Ser. No. 466,983, Feb. 15, 1983, Pat. No. 4,572,503.

[30] Foreign Application Priority Data

Jan. 17, 1983 [KR] Rep. of Korea ..... 1983-329[U]

[51] Int. Cl.[4] ..... A63B 5/20; A63B 21/30

[52] U.S. Cl. ..... 272/75; 272/68

[58] Field of Search ..... 272/67, 68, 75, 74, 272/DIG. 5, 135

[56] References Cited

U.S. PATENT DOCUMENTS

| | | | |
|---|---|---|---|
| 3,290,043 | 10/1963 | Sorensen | 272/68 |
| 3,687,458 | 8/1972 | Proctor, Jr. | 272/68 |
| 4,262,898 | 4/1981 | Lee | 272/68 |
| 4,572,503 | 2/1976 | Cho | 272/DIG. 5 |

*Primary Examiner*—Richard J. Apley
*Assistant Examiner*—S. R. Crow
*Attorney, Agent, or Firm*—Birch, Stewart, Kolasch & Birch

[57] ABSTRACT

A skipping rope handle is formed in two connected parts which are biased apart by a spring. The end of the skipping rope is attached to a button which is rotatable within an end of the handle parts. The handle parts can be held in closed condition by moving a ring axially over the rebated end of the handle part, when the handle has a generally conventional form and use. When released by the ring, the handle can be used for exercising the gripping muscles of the hand by forcing the parts towards one another against the bias provided by the spring.

3 Claims, 6 Drawing Figures

PIVOTAL SKIPPING ROPE HANDLES HAVING SPRING RESISTANCE

This is a division of application Ser. No. 466,983, filed Feb. 15, 1983, now U.S. Pat. No. 4,572,503.

DETAILED DESCRIPTION OF PRESENT INVENTION

Figure 1:
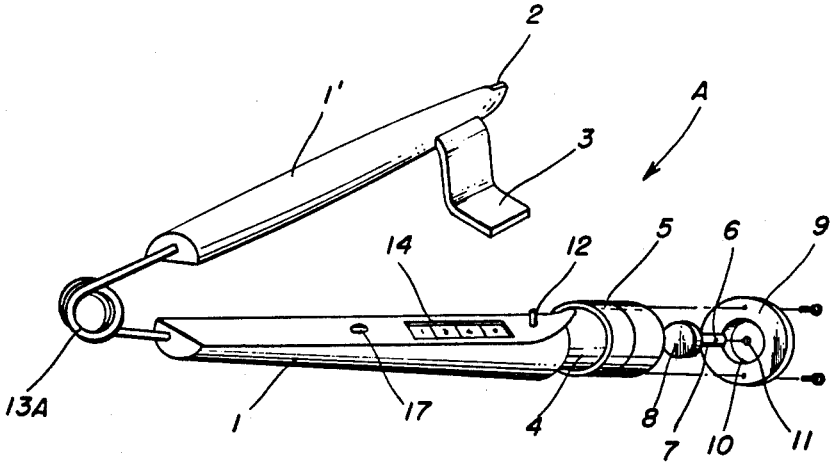
FIG. 1 is a perspective view of the present invention.

Present invention relates to a handle for a skipping rope set which includes a structure for a grasping power instrument which can be used as a grasping power instrument as well as a handle of a skipping rope and can also develop the muscle of a thumb concurrently.

A conventional handle of a skipping rope has a shape of a simple bar which is suitable for a man to grip and plays only a single role of connecting the hand to the skipping rope.

Further, a conventional grasping power instrument including a calculating machine for skipping times is not proper for a man to exercise all of the fingers due to its structure by which he can grasp it through only four finger excluding the thumb. In addition, it is improper to use this device in another exercise wherein it can be used as a grasping power instrument only. Moreover, because the whole length of a conventional instrument is elongated to include a spring provided at one end for returning the device after pushing the handle of the grasping power instrument it is inconvenient to carry on and there is a problem in reducing the spring when it is used for long time. Furthermore the instrument can't have a beautiful and fine appearance due to the spring projected laterally therefrom. Therefore, the present invention is provided to overcome the above disadvantages.

The first object of present invention is to provide a skipping and grasping exerciser concurrently by containing a structure of the grasping power instrument in the skipping handle connected to a link hanging skipping rope being attachable to or detachable from the handle. In addition, a thumb grasping means is provided on one side of a conventional grasping power instrument for keeping balance of whole hand muscle and for exercising the thumb.

The second object of present invention is to provide an improved grasping power instrument which is to be rotatably supported by inserting a pin through the handles while removing a spring elastically supported on both handles and outwardly projected therefrom. In addition, concaved portions are carved inside of the said handles and a coil spring is positioned in the concaved portion and also can reduce the whole length of the grasping power instrument by the length of the outwardly projecting conventional spring by setting the spring inwardly and putting the coil spring in the concaved portion. Thus, the device functions to exercise sufficiently as well as the conventional grasping power instrument by utilizing elasticity of the said spring and also to be of the beautiful and fine appearance thereby.

Referring now specifically to the drawings, the present invention will be described in detail hereinafter.

The handles of a skipping rope are substantially comprised of two pieces a right and a left piece, although in the present description, only the handle for the left hand is drawn and explained for convenience.

The handle of a skipping rope may have a similar shape and size of a conventional handle of a skipping rope, however, it is provided with two handles (1), (1') and a spring(13A) which is outwardly positioned between the handles(1), (1') in a conventional grasping power instrument. More specifically, a handle(1') of one side has the tip concaved with a fixing means (2), the under portion is slanted like a bow and a 'L' shaped thumb grasping means(3) is projected to one side of the handle (1'). A handle (1) of the other side has been provided with a ring(5) mounted in a concavity(4) in a circumference inwardly portion. A protrusion(7) is provided including a fixing hole(6) which is united with a supporter(8) and inserted in a recess(10). The protrusion(7) is screwed to a plugging means(9) penetrating a perforated hole(11) and also an indicator button(12) is positioned in a portion at which the handles (1) and (1') meet each other and a calculating machine (14) is provided which includes a spring(13C).

Figure 4:
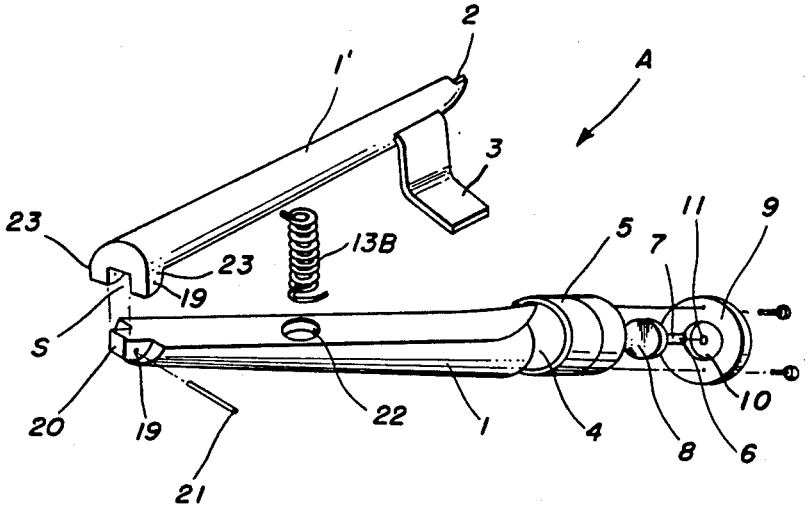
FIG. 4 is an exploded, perspective view on another embodiment of present invention.
Figure 5:
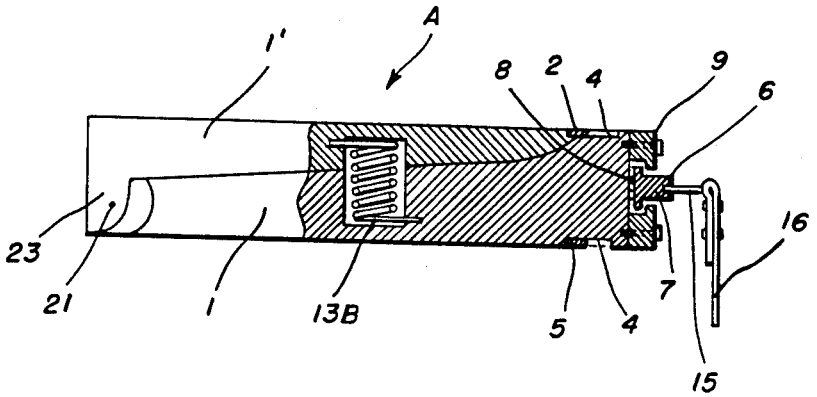
FIG. 5 is partial sectional view of a part of the embodiment in FIG. 4.

Referring to another embodiment of present invention illustrated in FIG. 4 and FIG. 5, reference numbers of those which are the same with the above-described parts are indicated by the same numerals.

In the handle of skipping rope having a grasping power instrument(A) as described above, there is inserting a pin(21) between each end instead of the spring(13A) supported elastically on each end of the said handles(1) and (1') and projected outwardly therefrom. For rotation a cavity(S) is provided on the end of the handle(1') and a projection(23) which forms a slot(S) is cut out with an aperture(19) in both side, while a convex portion(20) including an aperture(19) is provided on the end of other handle(1) to be inserted into the cavity. In addition, a pin(21) is fixed in the cavity and the aperture(19) and the handle(1),(1') of grasping power instrument(A) can be rotated by the insertion of the pin(21) through the said aperture(19). Further, a concaved portion(22) is formed in the handles (1),(1') to insert a coil spring(13B).

The provision of known calculating machine(14) is omitted in this embodiment, however, it is possible to provide the calculating machine as in the structure of the first embodiment.

A link(15) is provided for connecting a skipping rope, (16) is a skipping rope and a button is provided for count removal.

Now, the operation and effects of the present invention so constructed as descirbed above will be explained hereinafter.

Figure 2:
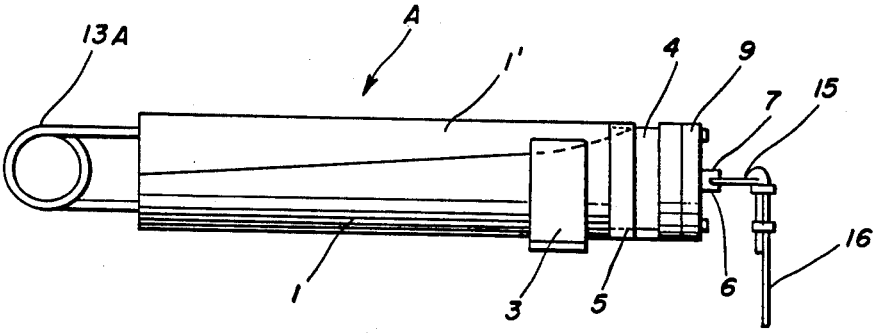
FIG. 2 is a side view of the present invention.
Figure 3A:
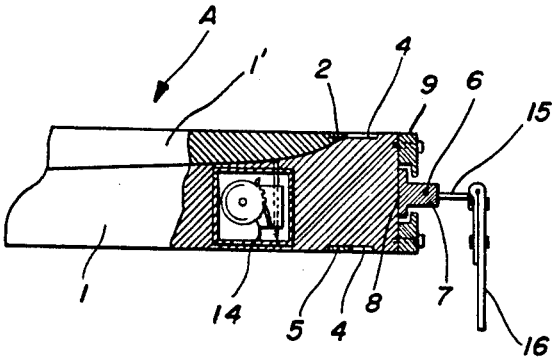
FIG. 3A is a partial cross-sectional view of a part of the present invention.
Figure 3B:
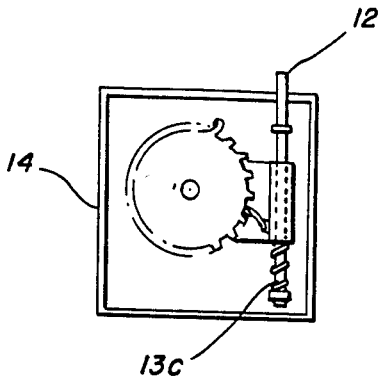
FIG. 3B is a partial enlarged section view of the present invention.

In the formation of the handle(1),(1') shaped as a circle or polygon, specifically for use as a handle for skipping rope, firstly the ring(5) is fitted to be forwarded before and behind the concavity(4) carved inwardly along the periphery of the tip of handle(1) and moved backward to the plugging means (9). Thereafter the handles(1),(1') are united as illustrated in FIG. 2 and the ring(5) is forwarded to the fixing means(2) disposed opposite to the plugging means(9) so that the fixing means(2) can be fixed therein.

According to this combination of the handles(1) and (1'), protrusion(7) is passed through the perforated hole(11), supporter(8) is inserted into the recess(10) of plugging means(9) and the plugging means(9) is screwed to the handle(1) thereafter. At that time the link(15) of the skipping rope(16) is linked into the fixing hole(6) of protrusion(7), finally a complete handle of skipping rope is formed and can be used.

On the other hand, for use as a grasping power instrument, when the ring(5) fixing by the fixing means(2) is moved to the plugging means(9), the handles(1),(1') are separated by the elasticity of spring(13A) and form a grasping power instrument as illustrated in FIG. 1, whereby the exercise for grasping power can be carried out.

Accordingly, the present invention can be used in both exercises of skipping and grasping respectively or concurrently on desire.

Referring to another embodiment, instead of the spring(13A) formed outwardly from the handles(1) and (1'), there is constructed a cavity(S) and a convex(20) and aperture(19) are coincident by inserting the convex(20) into the cavity(18) and inserting a pin(21) to rotatably mount the handle. Spring(13B) is set in the concaved portion(22) which has been carved in each inside portion of the handles (1) and (1'). Accordingly, the grasping power instrument can reduce the whole length by as long as the length of an outwardly projecting conventional spring by setting spring inwardly. The present invention is convenient to carry on, also possible to overcome the defect that a conventional spring(13A) is breakable in use over a long time. In addition, the present invention is beautiful and has a fine appearance.

It is another advantages of present invention that an 'L' shaped thumb grasping means(3) projects from the handle(1') and during exercise a thumb may touch and grasp the grasping means(3) whereby grasping exercise can be practiced even for the thumb of course to the other four fingers concurrently in order that the whole muscle of a hand can be developed evenly.

Furthermore, when the handle(1') of one side is closed by grasping power to the other handle(1), the tip of indicator button(12) is pushed in for causing a gear of known calculating machine(14) to rotate in turn to indicate the grasping times through the figure board so that the times of grasping and increasing degree of exercise in a day may be recorded.

In addition, as described hereto, the present invention provides a person with an opportunity to enjoy the exercise of skipping and grasping by purchasing a skipping rope only, besides, practice grasping exercise even to a thumb can be performed so that the balance of the whole hand muscle can be maintained and good health achieved. A person may take economical advantages of practicing two exercises by the purchase of only one piece of equipment.

What is claimed is:

1. A handle of a skipping rope comprising:

a first handle member being substantially semi-circular in cross section and having a first end, a gripping portion and a second end;

a second handle member being substantially semi-circular in cross section and having a first end, a gripping portion and a second end;

connecting means for pivotally connecting said first end of said first handle member to said first end of said second handle member, said connecting means being a coil spring having a first end operatively connected to said first end of said first handle member, and a second end operatively connected to a first end of said second handle member;

whereby said connecting means is additionally provided for biasing said handle members away from each other and for providing a resistance for an individual grasping said handle members and attempting to compress said handle members together;

supporting means rotatably mounted relative to the second end of at least one handle member, including means for attaching a jump rope to said at least one handle member; and retaining means operatively mounted adjacent to the second end of said at least one handle member for retaining said first handle member relative to said second handle member and forming a substantially circular handle.

2. A handle according to claim 1, and further including a thumb grip fixedly connected to one of said handle members for engaging an individual's thumb to assist in exercising the muscles of the hand, wherein said handle is more easily and effectively gripped.

3. A handle according to claim 1, wherein said retaining means is a ring axially displaceable along said first and second handle members for retaining said handle members together and mounted in a concavity at the second end of said second handle member such that upon actuation, said biased handle members are retained as a single handle.

* * * * *